US007040633B2

(12) United States Patent
Coburn et al.

(10) Patent No.: US 7,040,633 B2
(45) Date of Patent: May 9, 2006

(54) ROLLING OR GLIDING SPORTS EQUIPMENT

(75) Inventors: Shane Coburn, Santa Ana, CA (US); Dustin Latimer, Chandler, AZ (US); René Borel, Saint-Sylvestre (FR); Pierre Alexis Marechal, Annecy (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/322,538

(22) Filed: Dec. 19, 2002

(65) Prior Publication Data

US 2003/0205871 A1 Nov. 6, 2003

(30) Foreign Application Priority Data

Mar. 3, 2002 (FR) ..... 02 05818

(51) Int. Cl.
*A63C 1/02* (2006.01)

(52) U.S. Cl. ..... 280/11.3; 280/11.221

(58) Field of Classification Search ..... 280/11.221, 280/11.223, 11.26, 11.3, 11.31, 11.32, 11.33, 280/11.19, 11.233, 616; 36/114, 115, 116, 36/117, 88, 89

See application file for complete search history.

(56) References Cited

U.S. PATENT DOCUMENTS

| | | | | | |
|---|---|---|---|---|---|
| 1,312,739 | A | * | 8/1919 | Leblanc | 280/11.3 |
| 1,826,616 | A | * | 10/1931 | Johnson | 280/811 |
| 4,559,722 | A | * | 12/1985 | Norton | 36/89 |
| 4,959,912 | A | * | 10/1990 | Kaufman et al. | 36/117.4 |
| 5,142,798 | A | * | 9/1992 | Kaufman et al. | 36/117.4 |
| 5,171,033 | A | * | 12/1992 | Olson et al. | 280/11.202 |
| 5,401,041 | A | * | 3/1995 | Jespersen | 280/14.21 |
| D359,542 | S | * | 6/1995 | Sherman et al. | D21/764 |
| 5,454,173 | A | | 10/1995 | Falguere et al. | 36/117 |
| 5,675,917 | A | | 10/1997 | Falguere et al. | 36/117.2 |
| 5,722,187 | A | * | 3/1998 | Pamio et al. | 36/88 |
| 5,775,706 | A | | 7/1998 | Caeran | 280/11.22 |
| 5,839,736 | A | * | 11/1998 | Chiu et al. | 280/11.221 |
| 5,887,877 | A | * | 3/1999 | Nero | 280/11.221 |
| 5,913,526 | A | * | 6/1999 | Olson et al. | 280/11.231 |
| 5,915,703 | A | * | 6/1999 | Wrike | 280/11.231 |
| 5,918,889 | A | * | 7/1999 | Tai | 280/11.225 |
| 5,926,979 | A | | 7/1999 | Borel | 36/115 |
| 5,971,423 | A | * | 10/1999 | Hansen et al. | 280/634 |

(Continued)

FOREIGN PATENT DOCUMENTS

| | | |
|---|---|---|
| DE | 9307747 | 9/1993 |

(Continued)

*Primary Examiner*—Christopher P. Ellis
*Assistant Examiner*—Kelly E. Campbell
(74) *Attorney, Agent, or Firm*—Greenblum & Bernstein, P.L.C.

(57) ABSTRACT

Rolling or gliding sports equipment, such as an in-line roller skate, including such equipment or skate adapted to receive an independent boot. The equipment/skate according to the invention includes a frame, a base connected to the upper portion of the frame, and has an upper surface provided to support the walking sole of the boot, a rear quarter receiving the heel portion of the boot, an upper portion equipped with a comfort element surrounding the user's lower leg, a device for tightening the forefoot pressing the front portion of the boot against the upper surface of the base, a device for tightening the lower leg which tightens the upper portion against the user's lower leg, a device for maintaining the instep exerting a force on the instep portion of the boot and a reinforcement ensuring a continuous support from a lateral side to a medial side, and from the instep zone to the upper portion of the boot.

25 Claims, 6 Drawing Sheets

U.S. PATENT DOCUMENTS

| | | | | | |
|---|---|---|---|---|---|
| 6,018,892 | A | | 2/2000 | Acheson et al. | 36/89 |
| 6,047,975 | A | * | 4/2000 | Benoit et al. | 280/11.231 |
| 6,079,129 | A | | 6/2000 | Bourdeau et al. | 36/118.2 |
| 6,094,842 | A | | 8/2000 | Borel | 36/115 |
| 6,112,434 | A | | 9/2000 | Seltzer et al. | 36/115 |
| 6,123,342 | A | * | 9/2000 | Grell | 280/11.36 |
| 6,135,464 | A | * | 10/2000 | Borel | 280/11.221 |
| 6,164,669 | A | * | 12/2000 | Svensson | 280/11.3 |
| 6,340,164 | B1 | * | 1/2002 | Borel | 280/11.225 |
| 6,497,420 | B1 | * | 12/2002 | Ricci | 280/11.16 |

FOREIGN PATENT DOCUMENTS

| | | |
|---|---|---|
| FR | 2566672 | 1/1986 |
| FR | 2719197 | 11/1995 |
| WO | WO99/56575 | 11/1999 |

* cited by examiner

ROLLING OR GLIDING SPORTS EQUIPMENT

CROSS-REFERENCE TO RELATED APPLICATION

This application relates to French application No. 02.05818, filed on May 3, 2002, the disclosure of which is hereby incorporated by reference thereto in its entirety and the priority of which is claimed under 35 U.S.C. §119.

BACKGROUND OF THE INVENTION

1. Field of the Invention

The invention relates to rolling or gliding sports equipment, especially to foot fitting sports equipment dedicated to the practice of skating, skiing or snowboarding. The invention relates more particularly to aggressive roller skating provided for acrobatic maneuvers, these skates having significant requirements with regards to protecting the joints.

2. Description of Background and Relevant Information

Two large families of in-line roller skates can be defined, the one in which the boot is an integral part of the skate, and the other in which an independent walking boot is required in order to be able to use the skate.

There is also a third family of skates that can be classified as a hybrid family since the skates have a removable liner. In certain cases, these liners are provided for walking, but they are not actual boots, however.

When the boot is an integral part of the skate, it is possible to provide a rigid structure in the form of a shell that guarantees a good protection of the ankle joint. This is not the case in a skate having an independent boot.

A skate having an independent walking boot is disclosed in DE-U-93 07 747. The skate includes a shell provided with three ratchet tightening devices that are simple and identical to one another. Between the device for tightening the lower leg and the tightening device positioned on the instep, the shell has a wide cutout on each side in order to facilitate the flexion of the lower leg.

Such a skate offers a poor protection of the ankle joint, particularly in the forward flexional movements of the lower leg. Indeed, the shell, which constitutes the rigid structure, is not only discontinuous between the medial side and the lateral side, but also between the instep zone and the lower leg zone. Naturally, one can imagine that when the tightening of the instep is at a maximum, the two portions of the shell come into contact with each other. However, such conditions are rare and in most cases, the user will feel discontinuities in the support of the rigid elements between the medial portion and the lateral portion of the shell. The notched strap provided to connect these two portions is thin, more flexible and, being set back with respect to the shell, it does not press against the user's instep.

Likewise, the user will feel a discontinuity in the pressure exerted by the shell on his foot between the instep zone and the lower leg zone. Nevertheless, it is known that all of the sensors positioned at the skin's surface may be necessary for preventing injuries due to an overstretching of the joint capabilities. In this sense, the discontinuities in pressure exerted by the rigid structures of a skate on the user's foot put the joint at risk.

Moreover, such a skate does not ensure a good protection of the ankle joint during the lateral flexions of the leg, since the lateral retention of the collar is not sufficient due to the wide cutouts.

Furthermore, the skate described in DE-U-93 07 747.6 is not modular, and the adaptation thereof to various shoe sizes requires using an inner wedging system that displaces the foot toward the front with respect to the rear support portions of the shell, making these portions almost inoperative.

Finally, the tightening of this skate is evened out between the three tightening zones, since it is ensured in these three zones by three identical ratchet mechanisms that do not have any assisted tightening.

SUMMARY OF THE INVENTION

An object of the invention is to provide a rolling or gliding sports equipment that allows using an independent boot and that ensures a good protection of the ankle joint. The rolling or gliding sports equipment provided by the invention must also be inexpensive to manufacture and easy to use.

An other object of the invention is to provide a skate that offers increased capabilities for maintaining and tightening of the foot and boot in the in-step and the ankle joint regions.

According to one aspect of the invention, an in-line roller skate is adapted to receive a boot, this skate having a longitudinal frame on which a plurality of wheels are attached, a base whose upper surface is provided to support the walking sole of the boot, and a rear quarter, an upper portion of which is equipped with a comfort element surrounding the lower leg. The skate also has a device for tightening the forefoot pressing the front portion of the boot against the upper surface of the base, a device for tightening the lower leg tightening the upper portion against the lower leg, and a device for maintaining the instep exerting a force on the instep portion of the boot, and having a reinforcement ensuring a continuous support from a lateral side to a medial side, and from the instep zone to the upper portion of the skate. The reinforcement is made of a rigid plastic material and has two main portions. The first, called a saddle, substantially surrounds the entire zone of the user's instep and ensures continuous support from the inner lateral side to the outer lateral side. The saddle has a certain width of at least 3 centimeters (cm) so as to distribute the substantial tightening force exerted by the lever mechanism of the device for maintaining the instep. The second of these main portions, called the tongue, is linked to the saddle by means of a bridge, or bridge strap, from which it widens and curves so as to correspond to the front surface of the user's lower leg. The tongue extends substantially to the same level as the top of the upper portion of the skate, and thus ensures continuity in maintaining the supports from the instep zone to the top of the skate. A padding is attached under the reinforcement, which is slightly wider than the reinforcement itself, so as to avoid any direct contact between the reinforcement and the user.

Preferably, the device for maintaining the instep also has an adjusting mechanism connecting the saddle to the inner side of the quarter, and a tightening mechanism connecting the reinforcement to the outer side of the rear quarter. The tightening mechanism has a notched strap, a ratchet for retaining the notched strap and a lever for pulling the notched strap. This allows substantially increasing the force for maintaining the instep zone. The increased force developed by the tightening mechanism makes possible that the two sides of the rear quarter are pressed toward the interior, thereby firmly maintaining the ankle joint region. As for the adjusting mechanism, it allows a precise positioning of the saddle before the tightening occurs.

Another object of the invention is to provide an assembly constituted of a skate and of an independent boot ensuring a comfort and a protection of the ankle joint that are equivalent to those offered by a conventional aggressive skate having an integrated boot.

According to another aspect of the invention, an assembly is provided that has an in-line roller skate and an independent boot, this skate having a longitudinal frame on which a plurality of wheels are attached, a base whose upper surface is provided to support the walking sole of the boot, a rear quarter whose upper portion is equipped with a comfort element surrounding the lower leg. The skate also has a device for tightening the forefoot pressing the front portion of the boot against the upper surface of the base, a device for tightening the lower leg tightening the upper portion against the lower leg, and a device for maintaining the instep exerting a force on the instep portion of the boot, and having a reinforcement ensuring a continuous support from a lateral side to a medial side and from the instep zone to the upper portion of the skate. The reinforcement is made of a rigid plastic material and has two main portions. The first, called a saddle, substantially surrounds the entire zone of the user's instep, and ensures continuous supports from the inner lateral side to the outer lateral side. The second of these main portions, called the tongue, is attached to the saddle by means of a buckle strap, from which it widens and curves so as to correspond to the front surface of the user's lower leg. The tongue is extended substantially to the same level as the top of the upper portion of the skate, and thus ensures continuous supports from the instep zone to the top of the skate. The rear quarter has an opening whose upper ridge is substantially horizontal. The boot has a platform that projects in its rear portion. When the boot is inserted in the skate, the platform cooperates with this upper ridge and prevents any upward movement of the boot heel.

Preferably, the device for maintaining the instep is equipped with a mechanism that has a ratchet and a lever for assisted tightening.

BRIEF DESCRIPTION OF DRAWINGS

Other objects and advantages of the present invention will become apparent from the detailed reading of the following description, with reference to the drawings, and in which.

DETAILED DESCRIPTION OF THE INVENTION

Figure 1:
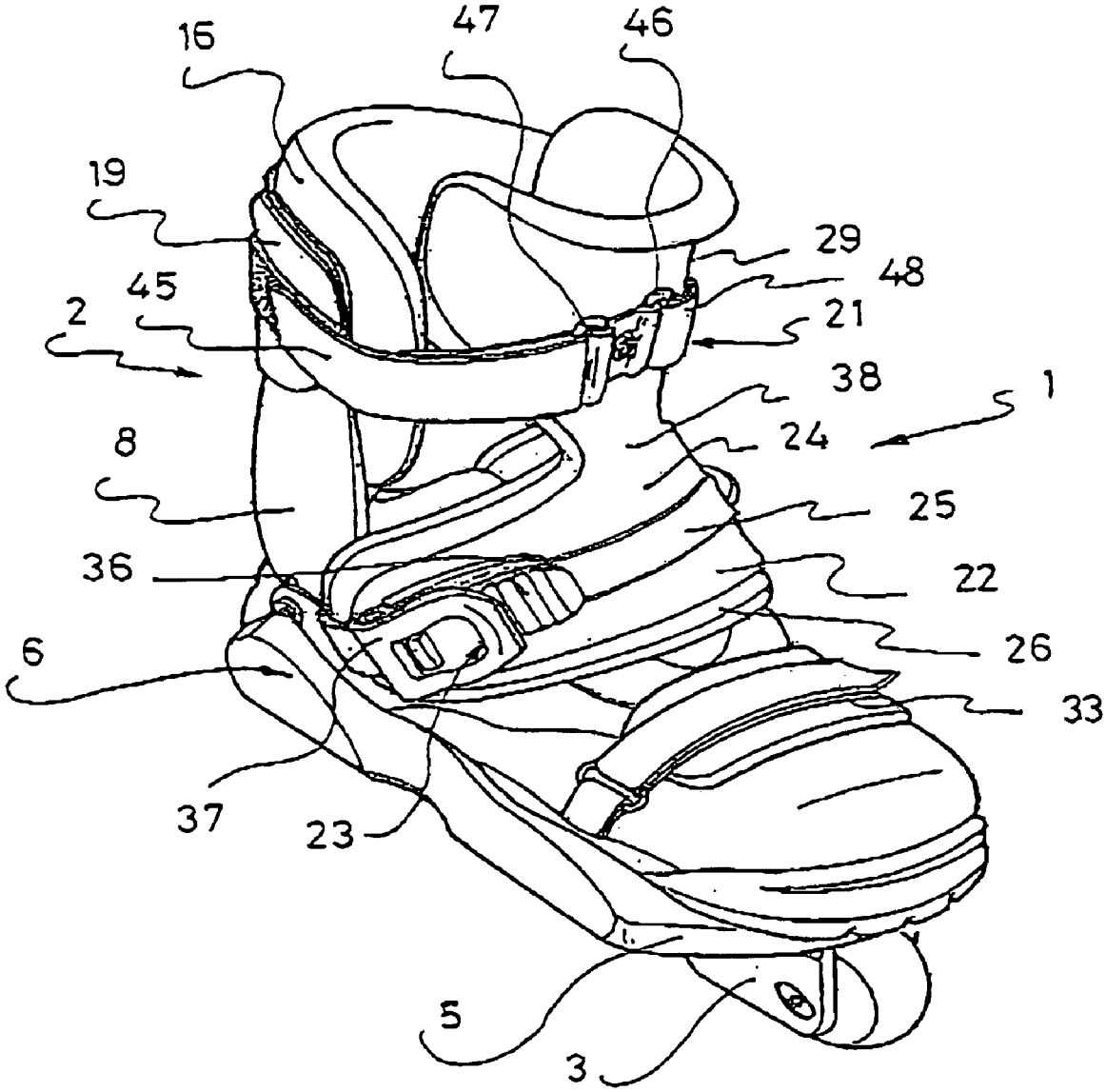
FIG. 1 is a front perspective view of the skate and boot assembly according to the invention.
Figure 2:
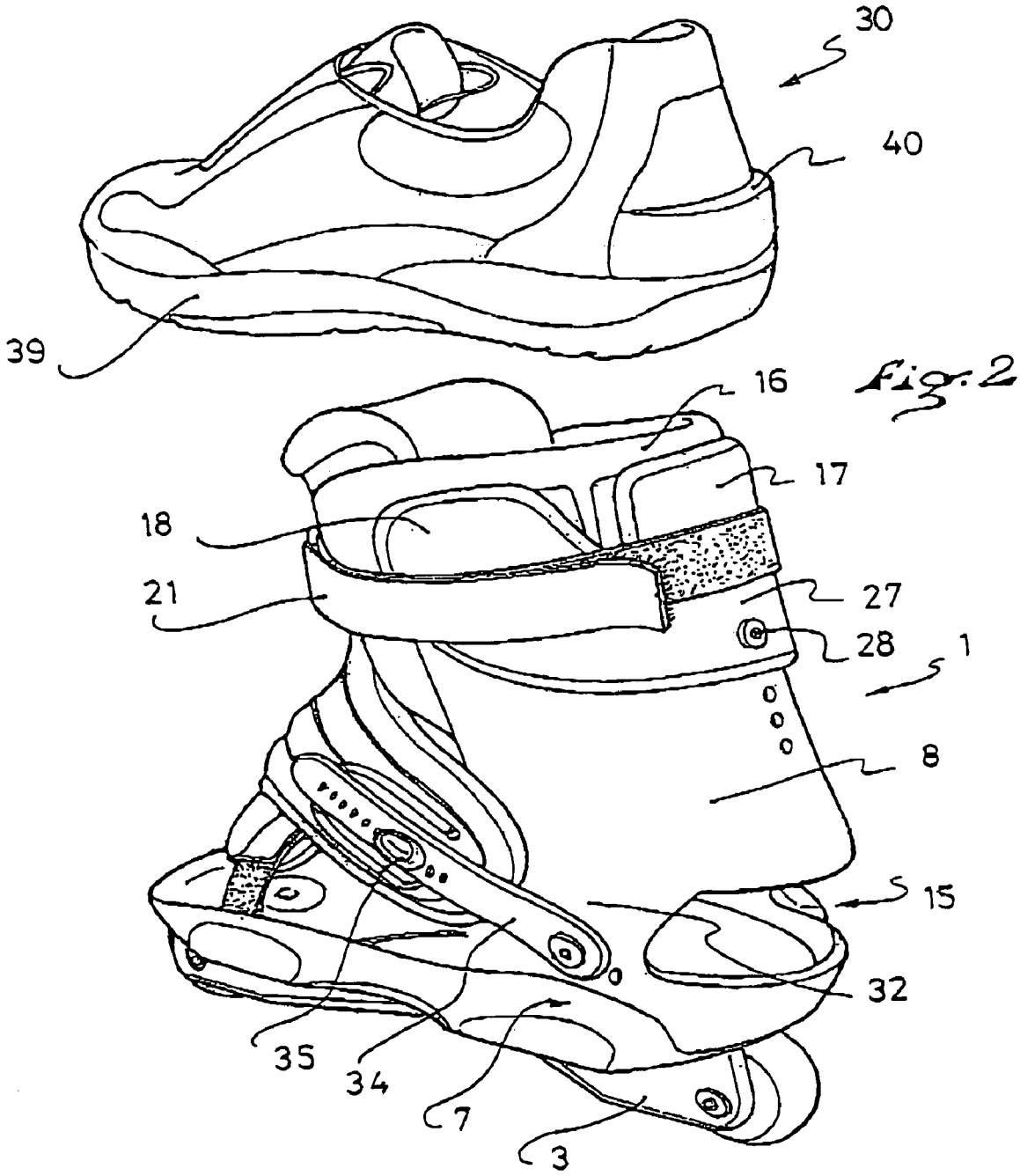
FIG. 2 is a rear perspective view of the skate and boot assembly according to the invention when the boot is removed from the skate.

FIGS. 1 and 2 show a front perspective view and a rear perspective view, respectively, of a skate according to a preferred embodiment of the invention. In FIG. 1, an independent boot 30 is inserted in the skate, whereas in FIG. 2, it is removed from the skate. The skate 1 has a fitting portion 2 attached by removable binding elements, such as screws or other fasteners, to a frame 3 equipped with a gliding element. In the example shown, the gliding element is represented by two wheels mounted in-line along a vertical longitudinal plane of the frame. Even though the skate in question is adapted in particular for aggressive skating, the choice of a frame having two wheels is not limiting within the scope of the invention, and a frame having three, four, or five wheels or possibly more is considered to be within the scope of the invention. It is also possible, alternatively, to attach to the frame 3 a blade for ice skating, or a short ski.

The fitting portion 2 includes a base 5 adapted to be attached to the frame, on the one hand, and for supporting the user's foot, on the other hand. The lower surface of the base 5 is wider than the frame 3 that is attached thereto. Thus, when the frame is attached, a medial gliding surface and a lateral gliding surface are defined. These medial and lateral gliding surfaces each have a front portion and a rear portion that are co-planar with the gliding plane of the skate. During certain maneuvers, the user can use one or the other of these gliding surfaces to slide on a rail or on a ramp. The base 5 is extended on the lateral side and on the medial side by two substantially vertical edges, a lateral edge 6 and a medial edge 7, that ensure the lateral stability of the boot in the skate.

The upper surface of the base 5 is substantially planar, or flat, and has a removable heel 31 (see FIG. 6) permitting the user's heel to be substantially raised. Given that the skate is capable of being used with independent boots that do not necessarily have the same heel heights, and given that the height of the heel is instrumental in the handling of the skate, it is preferred to provide a removable heel. Nevertheless, the invention encompasses a non-removable heel.

Figure 3:
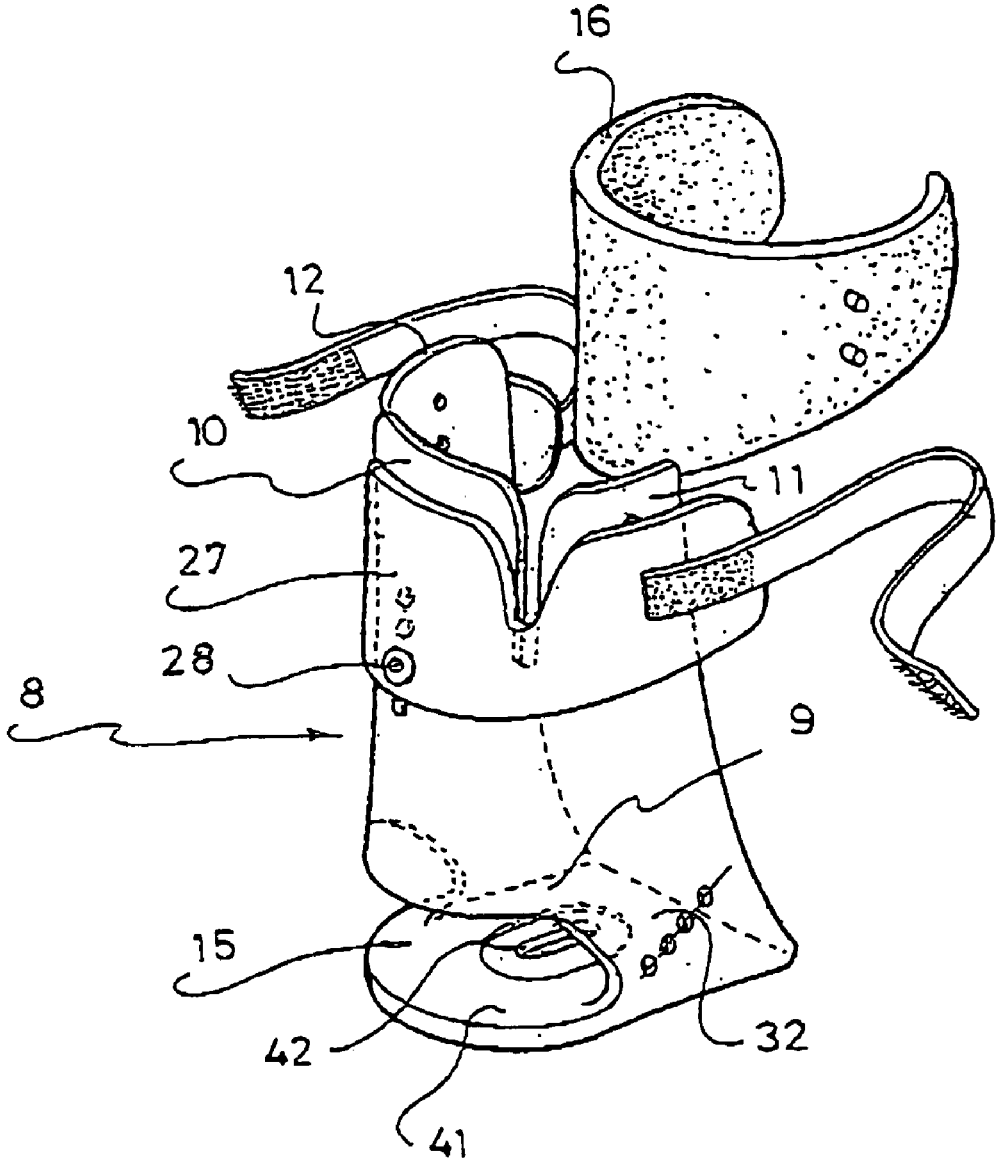
FIG. 3 is a rear perspective view of the rear quarter of the skate.

The fitting portion 2 also includes a rigid rear quarter 8 attached to the rear portion of the base 5. This quarter, shown in FIG. 3, has a rear stiffener 9 from which three rigid elements 10, 11, 12 originate. These elements extend up to the top portion of the skate and have an outer wing 11 supporting the outer side of the user's lower leg, an inner wing 12 supporting the inner side of the lower leg, and a rear wing 10 supporting the rear portion of the lower leg. These three wings are made of a plastic material and, with the rear stiffener, form a unitary element, i.e., the rear quarter 8. The structure of this element, associated with the choice of material, gives it a certain lateral flexibility toward both the inner side and the outer side. It is within the scope of the invention to provide the wings as distinct elements removably or non-removably attached to the rear stiffener. Furthermore, it is possible to give the outer 11 and inner 12 wings shapes that are substantially different from each other so as to distinguish their behavior in flexibility. An opening 15 is provided in the rear stiffener 9, at the base thereof. This opening improves the rearward flexibility of the rear quarter 8.

Between the opening 15 and the front edges of the rear quarter 8, the latter has a rigid zone 32, herein referred to as a post. The post, present on the lateral side as well as on the medial side, ensures the lateral stability of the user's leg and efficiently protects the ankle joint from sprains. Advantageously, according to the invention, the lateral post, and respectively the medial post, is extended by the lateral wing, and respectively by the medial wing. Since the thickness of the plastic material used for manufacturing the rear quarter is lesser in the area of the wings than in the areas of the posts, the rigidity of the quarter 8 is progressive, decreasing regularly from the bottom to the top.

The collar 27 is attached, by a screw or fastener 28 on the rear side of the skate, to the rear wing 10 or to the rear stiffener 9. The collar has a back 17, an inner arm 18, and an outer arm 19. A device 21 for tightening the lower leg extends the arms so that the collar tightens the top portion of the skate against the user's lower leg. The position of the arms 18, 19 and of the lower leg straps define a substantially horizontal tightening plane. An arrangement for the vertical adjustment of the tightening plane are provided in the form of a plurality of holes provided in the rear wing 10 and arranged along a vertical line.

The device 21 for tightening the lower leg uses flexible straps attached to the collar 27.

A pad 16 is inserted in the space formed by the three wings and has a foam-type shock absorbing material. The shock absorbing pad 16 extends only in the zone of the user's lower leg. It remains attached to the rear wing 10 by means of a screw. Advantageously, the same screw attaches the collar 27 and the pad 16 to the rear quarter 8. The pad is also directly attached to the collar 27, at the ends of the arms 18 and 19. In the same manner that it is possible to adjust the height of the device for tightening the lower leg, one can adjust the height of the position of the pad 16 in order to adapt it to various morphologies.

Figure 4A:
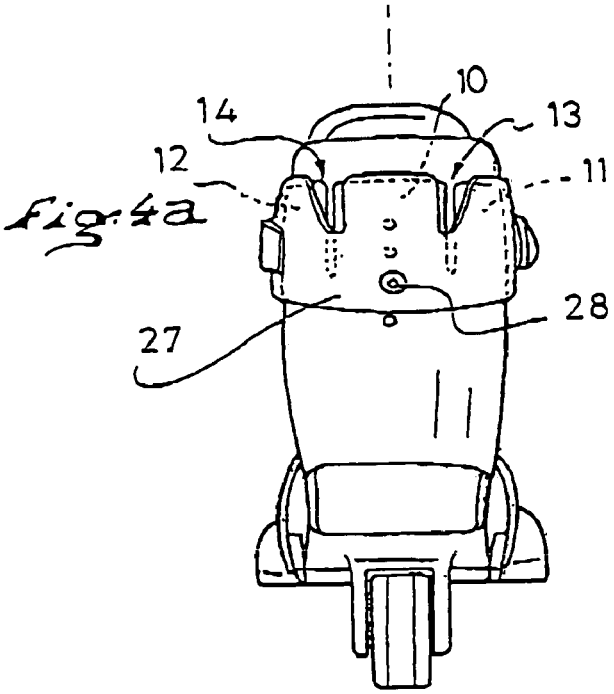
FIGS. 4*a*, 4*b*, and 4*c* are rear views of the skate showing the behavior thereof during lateral flexions of the ankle joint.

FIGS. 4*a,* 4*b,* and 4*c* show the behavior in lateral flexion of a skate according to the invention. Each of these figures shows a partial rear view of the skate at various times when the skate is in use.

In FIG. 4*a,* the skate is subject to no lateral deformation, the collar and the tightening plane that the latter defines are horizontal.

Figure 4B:
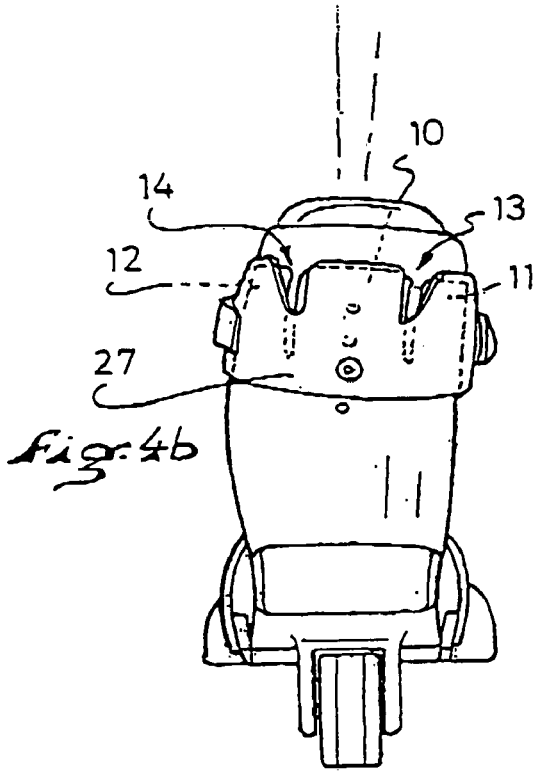

FIG. 4*b* shows the skate being subject to a lateral flexion to the right. The inner wing is shifted to the right, the collar pivots about the articulation axis and causes flexion of the outer wing to the left. The outer cutout 13 separating the outer wing 11 from the rear wing 10 allows flexion of the outer wing 11. Furthermore, the presence of the collar 27 that surrounds the upper portion of the skate causes flexion of the inner wing 12 to the right.

Figure 4C:
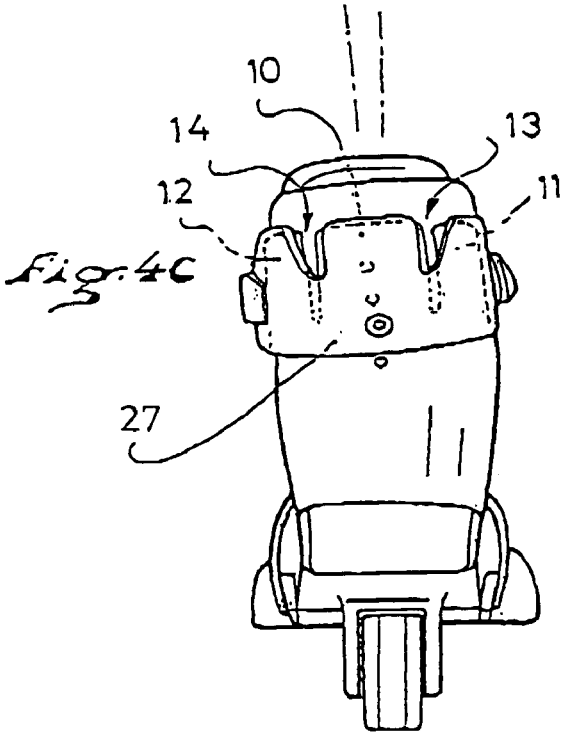

FIG. 4*c* shows a symmetrical behavior of the skate during flexion to the left.

Advantageously, the rear quarter 8 associated with the collar 27 according to the invention allows the skater to be in contact at all times with the rigid elements of the skate, and this even during flexion to the sides, without this contact hindering movement.

The fitting portion 2 also includes a device 33 for tightening the forefoot. It is shown in the form of a flexible strap attached on one side of the base 5, in the area of the zone occupied by the portion of the user's foot that surrounds the metatarso-phalangeal flexion zone. On the other side, a loop is attached that is used for the passage of the strap. The strap is provided with a fastening arrangement, such as hook and loop fasteners, i.e., such as VELCRO strips. The strap can be doubled with a comfort element having a foam-type material. Preferably, the means for attaching this strap and the loop do not project laterally from the outer and inner edges of the base. Thus, the forefoot strap and its fastening arrangement are protected from damage caused by rubbing the exposed portions of the skate against concrete, asphalt, or any other surface on which aggressive skating will occur. Several zones for anchoring the device for tightening the forefoot are provided so as to modify the longitudinal position of the tightening device.

In addition to the device 21 for tightening the lower leg and the forefoot strap, the fitting portion 2 has a device 23 for maintaining the instep and for applying each of the sides of the rear quarter 8 in close contact with the ankle joint region. This device has a saddle 22 adapted to cover the user's instep zone, an arrangement to adjust the position of the saddle, and a tightening mechanism. The adjusting arrangement has an anchoring zone constituted of a plurality of threaded inserts anchored in the rear quarter, preferably on the inner side thereof, and an adjustment strap 34 attached by means of a screw to one of the threaded inserts. The free end of this adjustment strap 34 has a plurality of aligned holes. The free end of the adjustment strap is attached to the saddle 22 by means of a screw or other fastener 35 having an enlarged head. Preferably, the enlarged head of the screw should allow a direct handling thereof by the user without having to use a tool. The adjustment mechanism allows the saddle to be centered on the user's instep, depending on his morphology and the boot that is used. The plurality of threaded inserts provided in the rear quarter allows the height of the saddle to be adjusted.

Strictly speaking, the tightening mechanism is positioned on the side opposite the adjusting arrangement. Contrary to the other two means for tightening the fitting portion, this one is assisted by a lever mechanism. It has an anchoring zone constituted of a plurality of threaded inserts anchored in the rear quarter, preferably on the outer side thereof, a tightening strap 36 attached by means of a screw to one of the threaded inserts, and a mechanism 37 for assisted tightening.

The free end of the tightening strap 36 is provided with notches adapted to cooperate with one ratchet of the mechanism 37. This mechanism also has a lever whose function is to assist the user during the tightening. Finally, the mechanism 37 has a button that releases the ratchet from its engagement with the notches so that untightening occurs.

The saddle 22 is a part of a reinforcement 24 that extends continuously from the inner side to the outer side. A slit 25 is provided in the central portion of the saddle. This slit allows softening the reinforcement when the user has to bend his leg forwardly. The reinforcement has a certain width, at least greater than 3 or 4 cm. A padding 26 is attached under the reinforcement. The padding 26 is slightly wider than the reinforcement 24 and, like the latter, extends continuously from the inner side to the outer side. The padding 26, which has no discontinuity from the top to the bottom, can be seen through the slit 25.

Contrary to other skates of the same type, the skate according to the invention promotes the tightening in the area of the instep and of the ankle as compared to the tightenings of the lower leg and of the forefoot. All of the tightening force developed due to the lever is distributed over the surface of the reinforcement, i.e., continuously from the inner side to the outer side as well as over the great width of the reinforcement. Furthermore, the padding 26 protects the user's instep against too rough a contact with the reinforcement.

Advantageously, the reinforcement 24 also has a tongue 29. This tongue 29 is manufactured from the same material as the saddle 22. In the example shown, the tongue and the saddle form a unitary element. The tongue and the saddle could also be two separate parts attached to one another. Due to rigidity, the saddle 22 and the tongue 29 are part of the structural elements of the skate, which also include the base and the rear quarter.

The tongue 29 includes a bridge 38 that links it to the saddle, in the middle thereof. From this strap, the tongue widens and curves so as to envelop the user's lower leg. The padding 26 is extended under the tongue so as to leave no portion of the tongue in contact with the user's leg.

Advantageously, the tongue 29 ensures in its own way a function similar to the one fulfilled by the three wings 10, 11, and 12 by accompanying the forward flexion of the leg. Furthermore, it improves the quality of the envelopment of the lower leg by the rigid elements of the skate. When the device for tightening the lower leg is maneuvered, instead of merely pressing the two lateral and medial wings against the lower leg, the device, by means of the tongue 29, also exerts a force that pushes the lower leg against the rear wing.

The presence of a rigid tongue 29 and the structural continuity that it offers with the saddle allows for substantial continuity in controlling the flexion, particularly toward the front.

The device 21 for tightening the lower leg has two flexible straps. The inner strap 48 is attached to the inner arm 18 of the collar and passes through a loop 46 attached to the tongue 29. It can be folded over on itself, a fastening means of the hook and loop type, i.e., such as a VELCRO brand type of fastener, therefore ensuring the retention of the strap. Likewise, the outer strap 45 is attached to the outer arm 19 of the collar and passes through a loop 47 attached to the tongue 29.

Because of the two loops 46, 47 attached to the tongue, and because of the independence of the two straps, the device for tightening the lower leg allows, in addition to the tightening of the lower leg, the very precise positioning of the tongue. Also, during a lateral flexion, the tongue will move with the user's lower leg in the bending. Since the bridge 38 connecting the tongue 29 and the saddle 22 is narrower than the tongue, it will promote the pivoting of the tongue with respect to the saddle. The precise positioning of the tongue is also possible when the user has not fully activated the tightening device. Thus, when the user only activates the device for maintaining the instep and wishes to keep the upper portion of the skate amply open, it is nonetheless possible for him to maintain the tongue in a central position, or even in any other position that he selects. In practice, in order to save time, the user can release only one of the two straps, i.e., the one positioned on the same side as the device for tightening the lower leg.

The boot shown in FIG. 2 has a walking sole and a low upper. A platform projects in the low portion of the upper. This platform is adapted to cooperate with the upper ridge, in the form of an edge of the opening 15. The instep zone of the boot is not provided with rigid thick elements so as to avoid any pain when the reinforcement 24 presses thereon. When the boot is inserted in the skate, as shown in FIG. 1, the mechanism for tightening the instep device is activated and, due to the force developed by the lever, the boot is pushed toward the rear until the platform passes under the upper. Once in place, the boot is completely immobilized.

Figure 5:
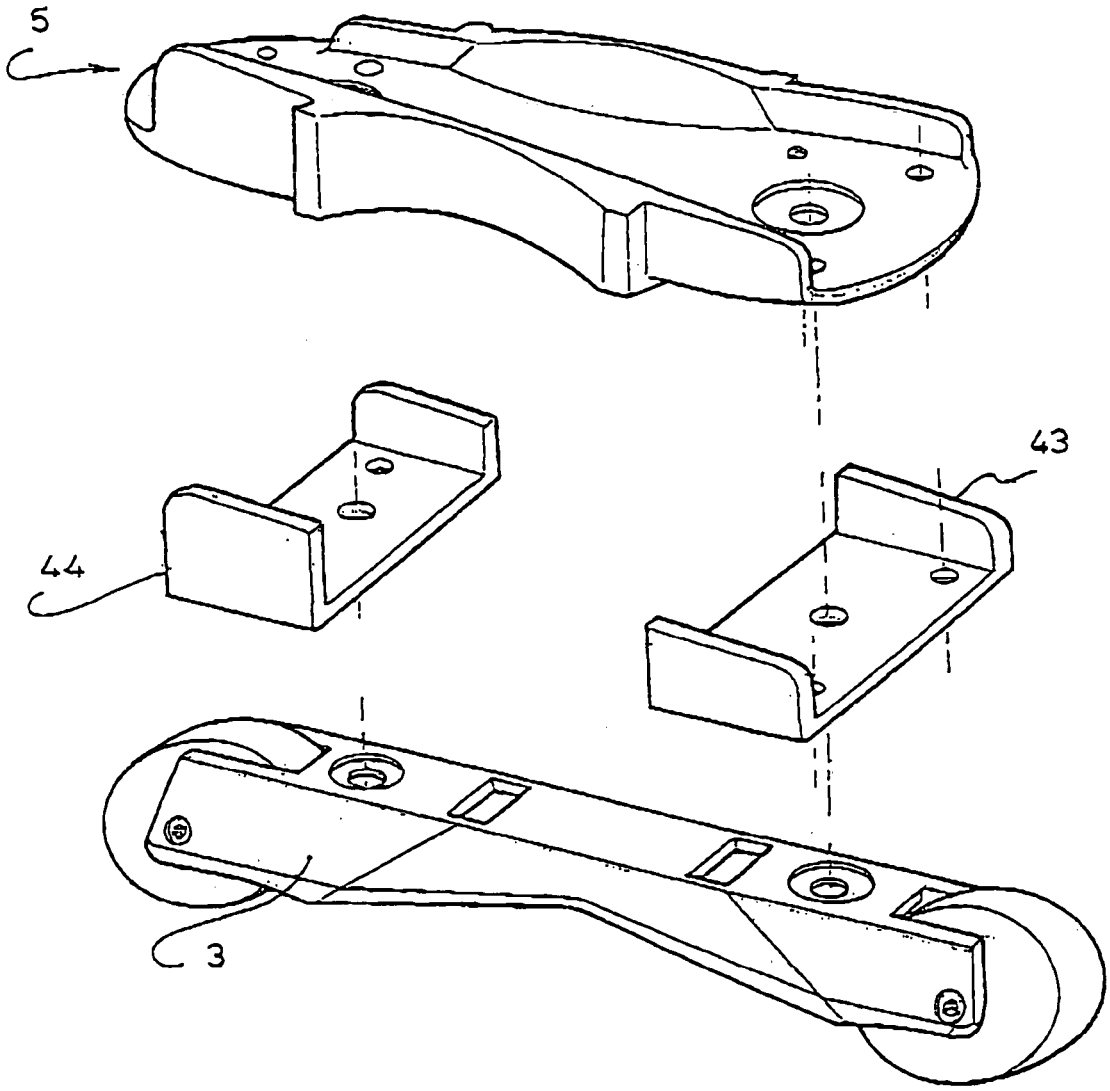
FIG. 5 is a perspective view of an alternative embodiment of the base.

FIG. 5 shows an alternative embodiment of the base equipping a skate according to the invention. In this embodiment, the base has two independent skids, viz, a front skid 43 and a rear skid 44. Advantageously, these skids have gliding properties that are different from that of the base. The gliding properties of the skids or of the base correspond to the ease that these elements offer in allowing for gliding on metal or concrete. These properties are related to the very nature of the material and, to some degree, to the shape of the element. The skids have gliding properties that are also different from those of the material constituting the frame, particularly those constituting the central arch of the frame.

These skids 43, 44 each have a horizontal portion that is inserted between the base and the frame. The lower surfaces of these skids project from the lower surface of the base so that when the user glides longitudinally, only the horizontal portions of the skids are in contact with the metal rail or with the ridge of the concrete. On each side of the horizontal portions, the skids have vertical portions that also project with respect to the surrounding zones of the base. The skids can be made of polyacetal or any other material that promotes gliding. The base and/or the frame can be made of polyamid filled with fibers so as to increase strength, or any other material that would have lower gliding properties than that of the skids. The skate according to the invention multiplies the possibilities for maneuvers since the user can either roll on the wheels, glide longitudinally on the skids at a high speed, or glide transversely on the central arch of the frame at a slower speed, due to the greater strength of the material of the frame for gliding.

Figure 6:
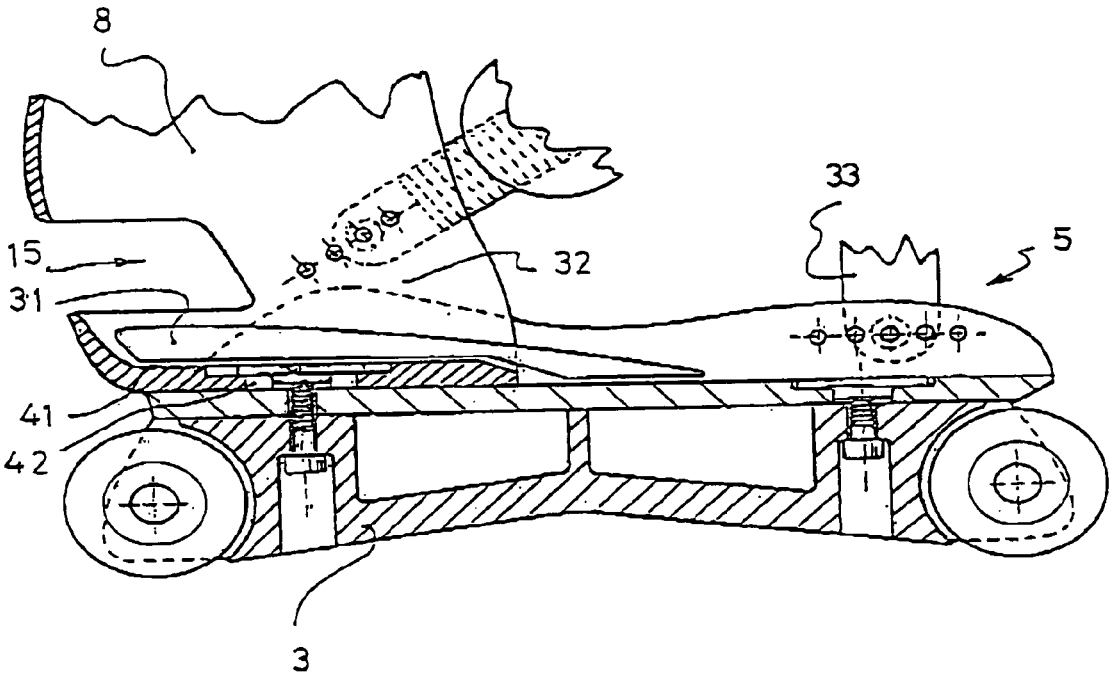
FIG. 6 is a partial cross-sectional view of the skate according to the invention.

FIG. 6 shows in the detail the binding of the rear quarter 8 to the base 5. The rear quarter 8 has a horizontal plate 41 laid on the rear portion of the upper surface of the base 5. The rear quarter 8, the base 5, and the frame 3 are maintained together by a single screw associated with a threaded insert. The threaded insert has a horizontal flange resting on the bottom of the plate of the rear quarter, and a threaded bush that is inserted in an oblong opening 42 that extends through the plate 41. A screw that is screwed from underneath the frame ensures the removable binding of the rear quarter 8 to the rear portions of the base and of the frame. A similar binding device ensures the fixing of the front portion of the frame to the base. The elongated opening 42 is oriented in the longitudinal direction and allows the position of the rear quarter 8 to be modified so as to adapt the skate to any of several sizes. The spacing of the two binding elements, such as two screws, is compatible with the disclosure of U.S. Pat. No. 6,648,346, issued Aug. 12, 2003, the disclosure of which is hereby incorporated by reference thereto in its entirety.

Although the invention was described with a certain degree of particularity, this disclosure is given by way of a non-limiting example, and modifications can be made to the elements hereinabove described without leaving the scope of the invention.

NOMENCLATURE

1—Skate
2—Fitting portion
3—Frame
4—Wheel
5—Base
6—Lateral edge
7—Medial edge
8—Rear quarter
9—Rear stiffener
10—Rear wing
11—Outer wing
12—Inner wing
13—Outer cutout
14—Inner cutout
15—Opening
16—Pad
17—Back
18—Inner arm
19—Outer arm
20—Notches
21—Device for tightening the lower leg
22—Saddle
23—Device for maintaining the instep
24—Reinforcement
25—Slit
26—Padding
27—Collar
28—Screw
29—Tongue
30—Independent boot

31—Heel
32—Post
33—Device for tightening the forefoot
34—Tightening strap
35—Screw having an enlarged head
36—Tightening strap
37—Mechanism
38—Bridge
39—Walking sole
40—Platform
41—Plate
42—Oblong opening
43—Front skid
44—Rear skid
45—Lower leg outer strap
46—Lower leg inner buckle
47—Lower leg outer buckle
48—Lower leg inner strap

What is claimed is:

1. A gliding or rolling sports equipment adapted to receive a boot comprising a front portion, an instep portion and a walking sole, said sports equipment comprising:

a longitudinal frame having a front end and a rear end;

a plurality of wheels attached to said frame;

a base connected to the upper portion of said frame and having an upper surface provided to support the walking sole of said boot;

a rear quarter receiving the heel portion of said boot, the rear quarter being rigidly attached to a rear portion of the base, the rear quarter comprising a rear stiffener non-articulated relative to the base;

an upper portion equipped with a comfort element surrounding the user's lower leg;

a device for tightening the forefoot pressing the front portion of said boot against said upper surface of the base;

a device for tightening the lower leg tightening said upper portion against the user's lower leg;

a device for maintaining the instep exerting a force on the instep portion of said boot, and comprising a reinforcement ensuring a continuous support from a lateral side to a medial side, and from the instep zone to the upper portion of the skate.

2. A gliding or rolling sports equipment according to claim 1, wherein the device for maintaining the instep has a padding attached under the reinforcement.

3. A gliding or rolling sports equipment according to claim 1, wherein the rear quarter is equipped with a plurality of threaded inserts that are used for anchoring the tightening mechanism and the adjusting arrangement of the device for maintaining the instep.

4. A gliding or rolling sports equipment according to claim 1, wherein the rear quarter comprises:

a horizontal plate;

a rear stiffener having a pair of rigid posts and an opening;

an outer lateral wing;

an inner lateral wing;

a rear wing separated from the outer lateral wing and from the inner lateral wing by cutouts for allowing flexion of the outer and inner lateral wings relative to the rear wing.

5. A gliding or rolling sports equipment according to claim 4, wherein the rear quarter has an arrangement for adjusting the position of the rear quarter with respect to the base so as to adapt the skate to any of a plurality of sizes.

6. A gliding or rolling sports equipment according to claim 1, comprising only two wheels, wherein the frame has a wide arch at two ends of which the two wheels are attached.

7. A gliding or rolling sports equipment according to claim 1, wherein the base has two gliding skids, one being attached to the front, the other to the rear of the base.

8. A gliding or rolling sports equipment according to claim 1, further comprising:

a collar attached to the rear quarter, said collar being positioned for supporting the user's lower leg;

wherein the device for maintaining the instep is independent of said collar.

9. A gliding or rolling sports equipment according to claim 1, further comprising:

a collar positioned for supporting the user's lower leg, said collar being attached to the rear quarter for articulation relative to the rear quarter;

wherein the device for maintaining the instep is adapted to apply a force to the instep independent of movement of said collar.

10. A gliding or rolling sports equipment comprising:

a longitudinal frame having a front end and a rear end;

a plurality of wheels attached to said frame;

a base connected to the upper portion of said frame and having an upper surface provided to support the walking sole of said boot;

a rear quarter receiving the heel portion of said boot;

an upper portion equipped with a comfort element surrounding the user's lower leg;

a device for tightening the forefoot pressing the front portion of said boot against said upper surface of the base;

a device for tightening the lower leg tightening said upper portion against the user's lower leg;

a device for maintaining the instep exerting a force on the instep portion of said boot, and comprising a reinforcement ensuring a continuous support from a lateral side to a medial side, and from the instep zone to the upper portion of the skate;

said reinforcement comprising:

a saddle connected to the rear quarter by an adjusting arrangement and by a tightening mechanism; and a tongue connected to the saddle and extending the latter toward the upper portion of the skate.

11. A gliding or rolling sports equipment according to claim 10, wherein the adjusting arrangement connects the reinforcement to the inner side of the rear quarter, and wherein the adjusting arrangement includes an adjustment strap having a plurality of aligned holes and a screw having an enlarged head.

12. A gliding or rolling sports equipment according to claim 10, wherein the saddle has a width greater than 3 centimeters.

13. A gliding or rolling sports equipment according to claim 12, wherein the saddle has a slit.

14. A gliding or rolling sports equipment according to claim 10, wherein the tightening mechanism connects the reinforcement to the outer side of the rear quarter, and wherein the tightening mechanism includes a notched strap, a ratchet for retaining the notched strap, and a lever for pulling the notched strap.

15. A gliding or rolling sports equipment according to claim 10, wherein the tongue has a strap that attaches the tongue to the saddle and a widened and folded portion.

16. A gliding or rolling sports equipment adapted to receive a boot comprising a front portion, an instep portion and a walking sole, said sports equipment comprising:

a longitudinal frame having a front end and a rear end;

a plurality of wheels attached to said frame;

a base connected to the upper portion of said frame and having an upper surface provided to support the walking sole of said boot;

a rear quarter receiving the heel portion of said boot;

an upper portion equipped with a comfort element surrounding the user's lower leg;

a device for tightening the forefoot pressing the front portion of said boot against said upper surface of the base;

a device for tightening the lower leg tightening said upper portion against the user's lower leg;

a device for maintaining the instep exerting a force on the instep portion of said boot, and comprising a reinforcement ensuring a continuous support from a lateral side to a medial side, and from the instep zone to the upper portion of the skate, the reinforcement comprising:

a saddle connected to the rear quarter by an adjusting arrangement and by a tightening mechanism, the saddle having a width greater than 3 centimeters;

the saddle having a slit, the slit separating the saddle into two strips, each said slit having a width greater than 1 centimeter; and a tongue connected to the saddle and extending the latter toward the upper portion of the skate.

17. A gliding or rolling sports equipment adapted to receive a boot comprising a front portion, an instep portion and a walking sole, said sports equipment comprising:

a longitudinal frame having a front end and a rear end;

a plurality of wheels attached to said frame;

a base connected to the upper portion of said frame and having an upper surface provided to support the walking sole of said boot;

a rear quarter receiving the heel portion of said boot, the rear quarter comprising:

a horizontal plate;

a rear stiffener having a pair of rigid posts and an opening;

an outer lateral wing;

an inner lateral wing;

a rear wing separated from the outer lateral wing and from the inner lateral wing by cutouts;

a collar arranged so as to cover said wings;

an upper portion equipped with a comfort element surrounding the user's lower leg;

a device for tightening the forefoot pressing the front portion of said boot against said upper surface of the base;

a device for tightening the lower leg tightening said upper portion against the user's lower leg;

a device for maintaining the instep exerting a force on the instep portion of said boot, and comprising a reinforcement ensuring a continuous support from a lateral side to a medial side, and from the instep zone to the upper portion of the skate.

18. A skate assembly comprising:

an in-line roller skate and an independent boot;

said boot comprising:

a front portion, an instep portion, a heel portion, a walking sole, and a platform projecting from the heel portion;

said skate comprising:

a longitudinal frame with a front end and a rear end;

a plurality of wheels attached to said frame;

a base connected to the upper portion of said frame and having an upper surface provided to support the walking sole of said boot;

a rear quarter receiving the heel portion of said boot, the rear quarter being rigidly attached to a rear portion of the base, the rear quarter comprising a rear stiffener non-articulated relative to the base;

an upper portion equipped with a comfort element surrounding the user's lower leg;

a device for tightening the forefoot pressing the front portion of said boot against said upper surface of the base;

a device for tightening the lower leg tightening said upper portion against the user's lower leg;

a device for maintaining the instep exerting a force on the instep portion of said boot, and comprising a reinforcement ensuring a continuous support from a lateral side to a medial side and from the instep zone to the upper portion of the skate;

said rear quarter comprising an opening, a ridge of said quarter cooperating with said platform, when said boot is inserted in said skate.

19. A skate assembly according to claim 18, wherein the rear quarter comprises:

a horizontal plate;

a rear stiffener having a pair of rigid posts on opposite sides of said opening;

an outer lateral wing;

an inner lateral wing;

a rear wing separated from the outer lateral wing and from the inner lateral wing by cutouts;

an arrangement for adjusting a position of the rear quarter with respect to the base so as to adapt the skate to any of a plurality of sizes.

20. A skate assembly according to claim 18, further comprising:

a collar attached to the rear quarter of said skate, said collar being positioned for supporting the user's lower leg;

wherein the device for maintaining the instep is independent of said collar.

21. A skate gliding or rolling sports equipment according to claim 18, further comprising:

a collar positioned for supporting the user's lower leg, said collar being attached to the rear quarter of said skate for articulation relative to the rear quarter;

wherein the device for maintaining the instep is adapted to apply a force to the instep independent of movement of said collar.

22. A skate assembly comprising:

an in-line roller skate and an independent boot;

said boot comprising:

a front portion, an instep portion, a heel portion, a walking sole, and a platform projecting from the heel portion;

said skate comprising:

a longitudinal frame with a front end and a rear end;

a plurality of wheels attached to said frame;

a base connected to the upper portion of said frame and having an upper surface provided to support the walking sole of said boot;

a rear quarter receiving the heel portion of said boot, said rear quarter comprising an opening, a ridge of said quarter cooperating with said platform when said boot is inserted in said skate;

an upper portion equipped with a comfort element surrounding the user's lower leg;

a device for tightening the forefoot pressing the front portion of said boot against said upper surface of the base;

a device for tightening the lower leg tightening said upper portion against the user's lower leg;

a device for maintaining the instep exerting a force on the instep portion of said boot, and comprising a reinforcement ensuring a continuous support from a lateral side to a medial side and from the instep zone to the upper portion of the skate;

said reinforcement comprising;

a saddle connected to the rear quarter by an adjusting arrangement and by a tightening mechanism; and a tongue connected to the saddle and extending the saddle toward the upper portion of the skate.

23. A skate assembly comprising:

an in-line roller skate and an independent boot;

said boot comprising:

a front portion, an instep portion, a heel portion, a walking sole, and a platform projecting from the heel portion;

said skate comprising:

a longitudinal frame with a front end and a rear end;

a plurality of wheels attached to said frame;

a base connected to the upper portion of said frame and having an upper surface provided to support the walking sole of said boot;

a rear quarter receiving the heel portion of said boot, said rear quarter comprising:

a horizontal plate;

a rear stiffener comprising a pair of rigid posts on opposite sides of an opening, said opening having an upper edge, said upper edge cooperating with said platform of the boot when the boot is inserted into the skate;

an outer lateral wing;

an inner lateral wing;

a rear wing separated from the outer lateral wing and from the inner lateral wing by cutouts;

an arrangement for adjusting a position of the rear quarter with respect to the base so as to adapt the skate to any of a plurality of sizes;

a collar arranged so as to cover said wings;

an upper portion equipped with a comfort element surrounding the user's lower leg;

a device for tightening the forefoot pressing the front portion of said boot against said upper surface of the base;

a device for tightening the lower leg tightening said upper portion against the user's lower leg;

a device for maintaining the instep exerting a force on the instep portion of said boot, and comprising a reinforcement ensuring a continuous support from a lateral side to a medial side and from the instep zone to the upper portion of the skate.

24. A gliding or rolling sports equipment adapted to receive a boot, the boot having a front portion, an instep portion, and a walking sole, said sports equipment comprising:

a longitudinal gliding or rolling element;

a base connected to an upper portion of said gliding or rolling element and having an upper surface provided to support the walking sole of the boot;

an upper boot portion surrounding a user's lower leg;

a rear quarter to receive a heel portion of the boot, the rear quarter being rigidly attached to a rear portion of the base, the rear quarter comprising a rear stiffener non-articulated relative to the base;

a device for tightening a user's forefoot by pressing the front portion of the boot against said upper surface of said base;

a device for tightening the user's lower leg;

a device for maintaining the instep portion of the boot comprising:

a reinforcement ensuring continuous support from a lateral side to a medial side of the sports equipment, and from the instep portion of the boot to said upper portion of said gliding or rolling element;

an arrangement including a strap connecting said reinforcement to one of the lateral and medial sides of said sports equipment, said arrangement being unmodified when the user inserts the boot into said gliding or rolling equipment;

a tightening mechanism for exerting a tightening force on the instep portion of the boot.

25. A gliding or rolling sports equipment according to claim 24, wherein:

said arrangement of the device for maintaining the instep portion of the boot is adapted to be positioned only once and fixed according to the boot and the user's instep periphery over successive removals and insertions of the user's boot.

* * * * *